US011980298B1

(12) United States Patent
Galjour

(10) Patent No.: US 11,980,298 B1
(45) Date of Patent: May 14, 2024

(54) MULTI-SECTIONAL SINUOUS SPRING FOR FURNITURE

(71) Applicant: Benjamin Andrew Galjour, Tupelo, MS (US)

(72) Inventor: Benjamin Andrew Galjour, Tupelo, MS (US)

( * ) Notice: Subject to any disclaimer, the term of this patent is extended or adjusted under 35 U.S.C. 154(b) by 0 days.

(21) Appl. No.: 17/939,802

(22) Filed: Sep. 7, 2022

(51) Int. Cl.
*A47C 7/30* (2006.01)
*A47C 7/35* (2006.01)

(52) U.S. Cl.
CPC . *A47C 7/30* (2013.01); *A47C 7/35* (2013.01)

(58) Field of Classification Search
CPC .. A47C 7/287; A47C 7/28; A47C 7/30; A47C 7/35
USPC ..... 297/452.52
See application file for complete search history.

(56) References Cited

U.S. PATENT DOCUMENTS 2,384,191 A * 9/1945 Neely ..... A47C 7/30 267/102
2,571,184 A 10/1951 Bateman et al.
2,591,185 A 4/1952 Neely
2,764,227 A 9/1956 Williams et al.
2,812,803 A 11/1957 Neely
2,835,314 A 5/1958 Neely
2,848,038 A * 8/1958 Bank ..... A47C 7/30 297/452.52
3,645,523 A * 2/1972 McMahon ..... A47C 7/30 267/107
3,907,266 A * 9/1975 Sano ..... F16F 3/02 267/102
5,188,343 A * 2/1993 Galea ..... A47C 7/025 5/255
6,170,915 B1 * 1/2001 Weisz ..... A47C 7/35 297/452.52
2017/0119162 A1 * 5/2017 Bullard ..... A47C 7/30

* cited by examiner

*Primary Examiner* — Milton Nelson, Jr.
(74) *Attorney, Agent, or Firm* — George L Williamson

(57) ABSTRACT

Method and apparatus for an improved sinuous spring for use on the seat box of a piece of furniture. The sinuous spring includes three pieces wherein a middle piece or section is placed in between a front and rear section. After the middle section is placed between the other two sections, the middle section would be folded so as to be disposed under one section and over the top of the other section and then clipped securely so that a single piece of spring having the correct length and tension is formed in the process.

9 Claims, 5 Drawing Sheets

MULTI-SECTIONAL SINUOUS SPRING FOR FURNITURE

BACKGROUND OF THE INVENTION

Field of the Invention

The present invention relates generally to furniture and more particularly, is concerned with a device for multi-sectional sinuous spring for use with the seat box of a piece of furniture.

Description of the Related Art

Devices relevant to the present invention have been described in the related art; however, none of the related art devices disclose the unique features of the present invention.

In U.S. Pat. No. 2,591,185 dated Apr. 1, 1952, Neely disclosed a wire frame structure. In U.S. Pat. No. 2,812,803 dated Nov. 12, 1957, Neely disclosed a wire frame structure. In U.S. Pat. No. 2,764,227 dated Sep. 25, 1956, Williams, et al., disclosed a formed spring unit and assembly thereof. In U.S. Pat. No. 2,835,314 dated May 20, 1958, Neely disclosed a wire frame structure. In U.S. Pat. No. 2,571,184 dated Oct. 16, 1951, Bateman, et al., disclosed a zig-zag spring seat.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a method and apparatus for providing an improved sinuous, i.e., zig-zag, spring for use on the seat box of a piece of furniture. The sinuous spring of the present invention includes three pieces wherein a middle piece or section is placed in between a front and rear section. After the middle section is placed between the other two sections, the middle section would be folded so as to be disposed under one section and over the top of the other section and then clipped securely so that a single piece of spring of the correct length and tension is formed in the process.

An object of the present invention is to improve safety in a furniture manufacturing facility. A further object of the present invention is to provide a three-piece, sinuous spring for use with the seat box of a piece of furniture. A further object of the present invention is to reduce the costs of manufacturing furniture. A further object of the present invention is to provide a sinuous spring which can be more easily assembled by an operator in a furniture manufacturing facility. A further object of the present invention is to provide a sinuous spring which can be more easily manipulated by an operator in a furniture manufacturing facility. A further object of the present invention is to provide a sinuous spring which can be relatively easily and inexpensively manufactured.

The present invention has many advantages over the prior art. The present invention provides a multi-section sinuous or zigzag furniture spring having three sections with each section being joined to each other by a clip or like fastener. One advantage of this spring is that it would be easier to install on the piece of furniture. Conventional sinuous wire springs compose the seat section of the vast majority of upholstered furniture made in the United States wherein the sinuous spring is installed by clipping it on the back of a sofa rail and then pulling it toward the clips in the front of the sofa rail. This procedure is generally the hardest job in an upholstery plant and also the source of the largest number of injuries to workers and workers compensation claims. The three-piece spring of the present invention would minimize the effort performed by the workers and reduce injuries to workers and workers compensation claims.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
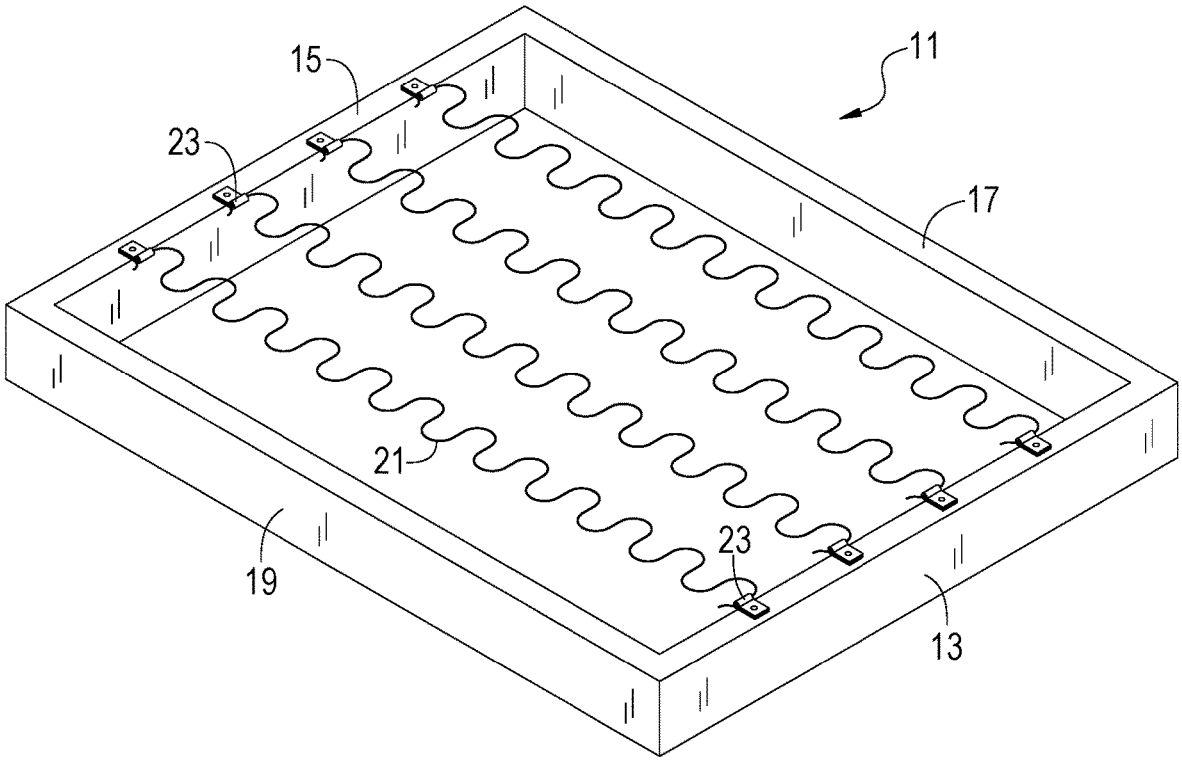
FIG. 1 Prior Art
FIG. 1 is a perspective view of a prior art seat box.

With regard to reference numerals used, the following numbering is used throughout the drawings.

10 present invention
11 prior art seat box
12 front or first rail of seat box
13 front rail of prior art seat box
14 rear or second rail of seat box
15 rear rail of prior art seat box
16 front or first sinuous spring
17 side rail of prior art seat box
18 front or first end of first sinuous spring

19 side rail of prior art seat box
20 rear or second end of first sinuous spring
21 spring of prior art seat box
22 rear or second sinuous spring
23 clip for spring of prior art seat box
24 front or first end of second sinuous spring
26 rear or second end of second sinuous spring
28 first clip
30 second clip
32 space
34 central or third sinuous spring
36 front or first end of third sinuous spring
38 rear or second end of third sinuous spring
40 third clip
42 fourth clip
44 newly formed piece of sinuous spring
46 fifth clip
48 link
50 first end
52 second end
54 first link clip
56 second link clip
58 third link clip

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 13 illustrate the present invention wherein a three-piece sinuous spring for use in the seat box of a piece of furniture is disclosed and which is generally indicated by reference number 10.

Turning to FIG. 1, therein is shown a perspective view of a prior art seat box 11 including a front rail 13, rear rail, 15, side rails 17, 19, a plurality of springs 21 and clips 23 wherein a rear end of a spring 21 is clipped to the rear rail 15 and a front end of spring 21 is clipped to the front rail 13. In standard practice, the process of clipping the spring 21 to the front and rear rails 13, 15 causes many injuries during the manufacturing process for a piece of furniture. It would be understood by one skilled in the art that in this patent application the present invention 10 is applied to the seat box area 11, i.e., seat bottom, of a piece of furniture upon which a person would sit, but it should be recognized that the principle of the present invention 10 could also be used in association with a seat back or other portions of a piece of furniture as a manufacturer might choose.

It should be clear that the seat box 11 as shown in FIG. 1 includes a plurality of sinuous spring members 21 positioned side-by-side within the area of the seat box and extending from the front rail 13 to the rear rail 15 of the seat box so that each spring member would carry a portion of the load. Each member or piece of sinuous spring 21 extends parallel to each other in substantially a straight line from the front rail 13 to the rear rail 15 of the seat box 11. Each piece of sinuous wire 21 as used in the present invention 10 is comprised of a series of interconnecting S-shaped loops. Also, the clips 23 as used with the present invention 10 are commonly constructed of sheet metal in the furniture industry wherein the end most S-shaped portion of each spring unit 21 is attached to either the front rail 13 or rear rail 15 of the seat box 11.

Figure 2:
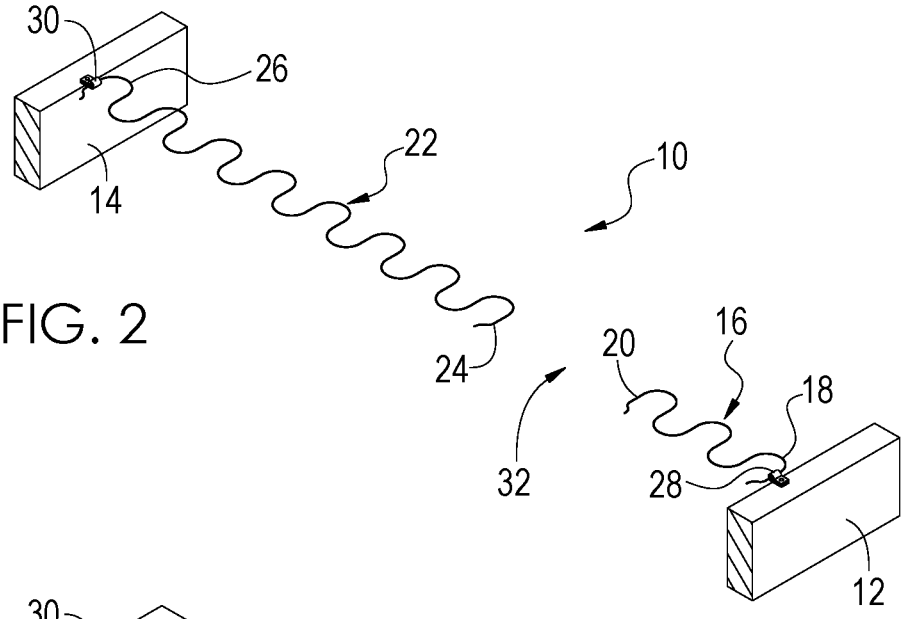
FIG. 2 is a perspective view of two of the components of the present invention.

Turning to FIG. 2, therein is shown the present invention 10 wherein a first or front rail 12 of a seat box (this will be shown in a separate figure) is illustrated along with a second or rear rail 14 of the seat box. Initially, there is shown a first or front section of sinuous spring 16 having a front or first end 18 and a rear or second end 20. Also shown is a second piece of sinuous spring 22 having a front or first end 24 and a second or rear end 26 wherein the first end 18 of the first piece of sinuous spring 16 is attached to the first rail 12 with a first or front clip 28 and wherein the rear end 26 of the second sinuous spring 22 is attached to the rear rail 14 with a second or rear clip 30. It should be noted that a space 32 is initially provided between the ends of the first and second pieces of sinuous spring 16, 22 which space 32 will later receive a third piece of sinuous spring.

Figure 3:
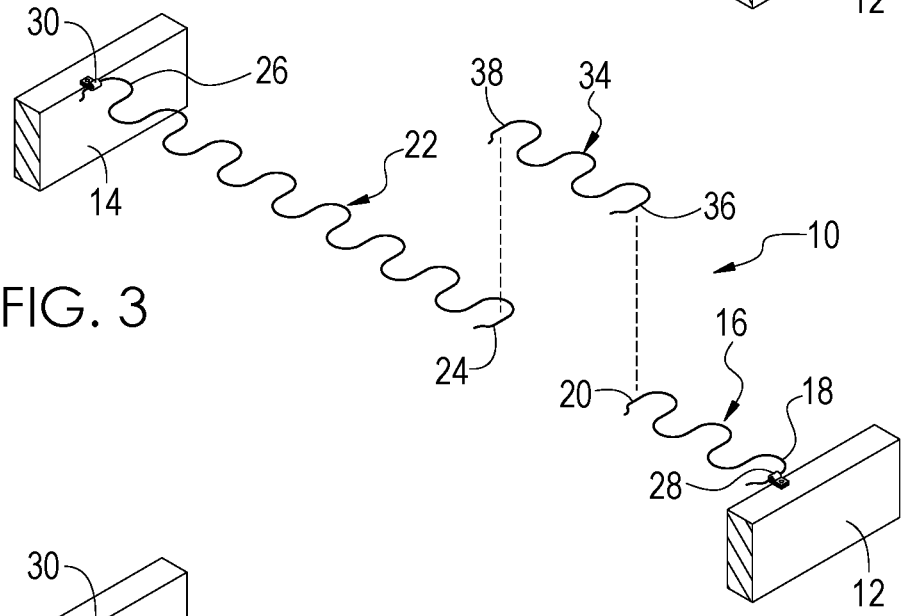
FIG. 3 is a perspective view of the components of the present invention depicting a step of the assembly process of the present invention.

Turning to FIG. 3, therein is shown the third piece 34 of sinuous spring having a first or front end 36 and a rear or second end 38 illustrating that the third piece of sinuous spring 34 is in position to be inserted between the free ends of the first and second pieces of sinuous pieces 16, 22.

Figure 4:
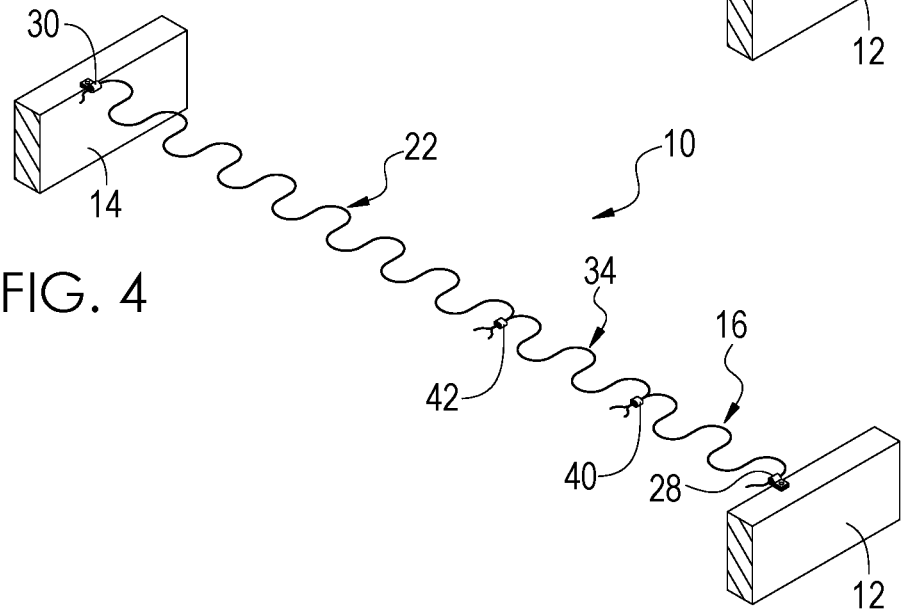
FIG. 4 is a perspective view of the components of the present invention depicting a step of the assembly process of the present invention.

Turning to FIG. 4, therein is shown the third piece of sinuous spring 34 inserted between first 16 and second 22 pieces of sinuous spring wherein there is also shown a first or front clip 40 joining the front or first end of the third piece of sinuous spring 34 to the first piece of sinuous spring 18 along with a second clip 42 which joins the third piece of sinuous spring 34 to the second piece of sinuous spring 22.

Figure 5:
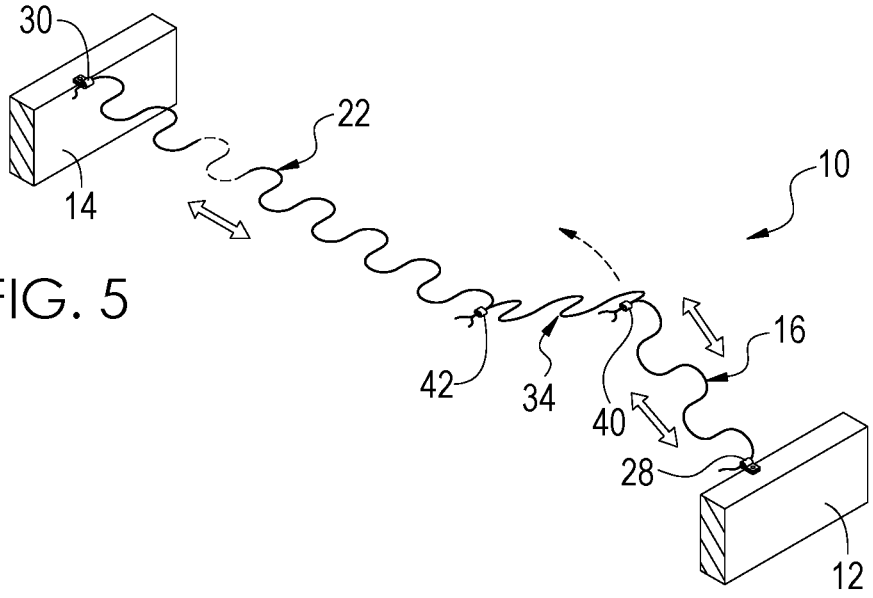
FIG. 5 is a perspective view of the components of the present invention depicting a step of the assembly process of the present invention.
Figure 6:
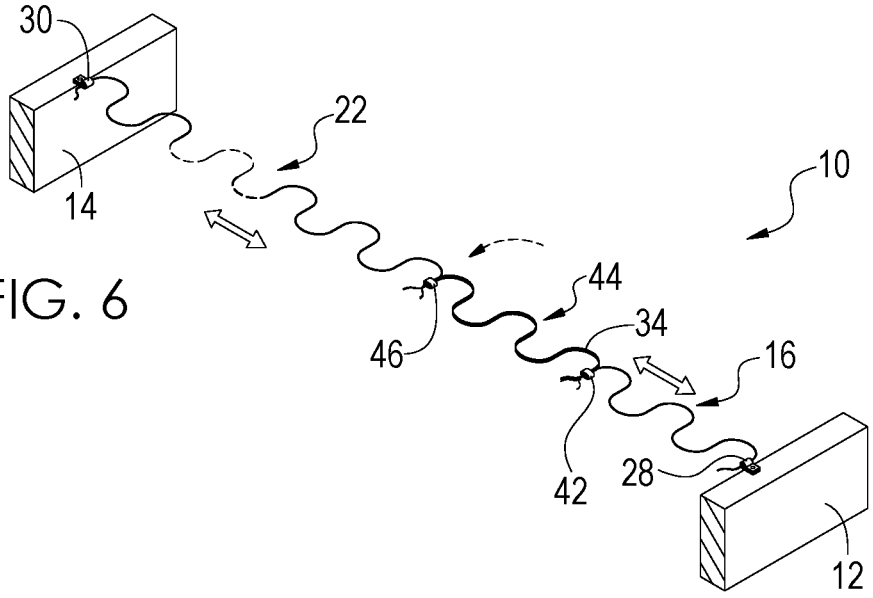
FIG. 6 is a perspective view of the components of the present invention depicting a step of the assembly process of the present invention.

Turning to FIG. 5, therein is shown a process by which the first or front end 36 of the third piece of sinuous spring 34 is being folded over a front end portion of the second sinuous spring 22 so that the third piece of sinuous spring 34 can be joined to the second piece of sinuous spring 22 to form a single piece of sinuous spring 44 which is shown in FIG. 6.

Turning to FIG. 6, therein is shown a newly formed sinuous spring 44 resulting from the completed folding process as shown in FIG. 4 wherein the sinuous spring 34 is folded over and joined to the second piece of sinuous spring 22 and clipped at 46 so as to form a new, single length or piece of sinuous spring 44. During the manufacturing process as taught with the present invention 10, each member of sinuous spring is adjusted or pulled so that it is tightened to a user-selected degree so as to support a user-selected load according to the requirements of the piece of furniture being manufactured.

Figure 7:
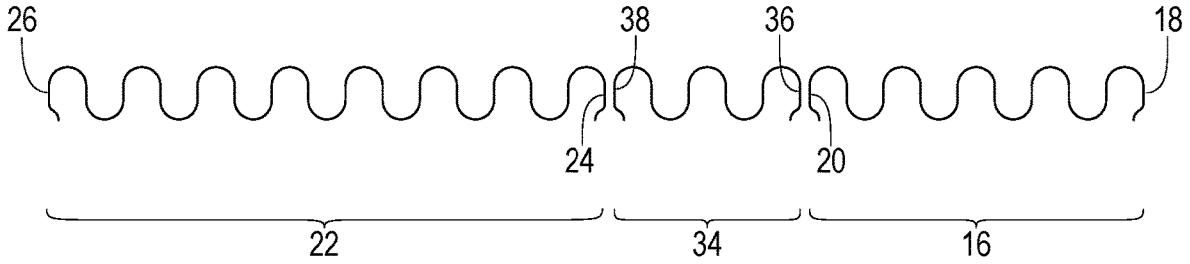
FIG. 7 is a plan view of the components of the present invention.

Turning to FIG. 7, therein is shown a plan view of the present invention 10, showing the same configuration as previously shown in FIG. 2, showing the three pieces of sinuous spring 16, 22, 34 which will be joined together to form a new piece 44 of sinuous spring. Shown is a first or front section of sinuous spring 16 having a front or first end 18 and a rear or second end 20. Also shown is a second piece of sinuous spring 22 having a front or first end 24 and a second or rear end 26 wherein the first end 18 of the first piece of sinuous spring 16 is attached to the first rail 12 with a first or front clip 28 wherein the rear end 26 of the second sinuous spring 22 is attached to the rear rail 14 with a second or rear clip 30.

Figure 8:
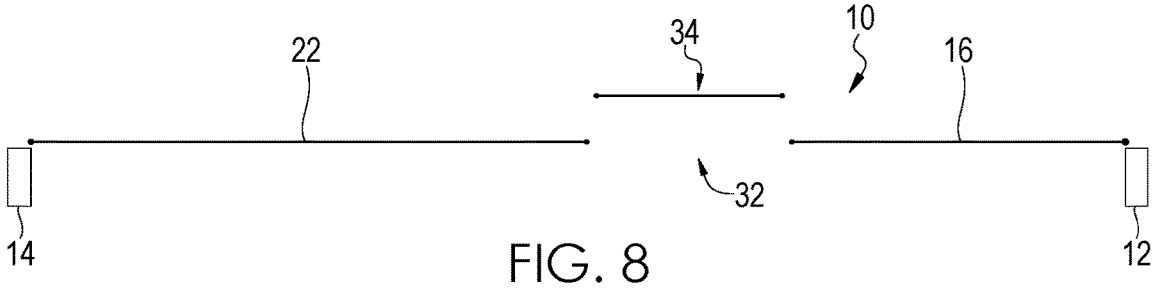
FIG. 8 is a side elevation view of the components of the present invention illustrating the method of assembly of the present invention.

Turning to FIG. 8, therein is shown the third piece 34 of sinuous spring having a first or front end 36 and a rear or second end 38 illustrating that the third piece of sinuous spring 34 is in position to be inserted between the free ends of the first and second pieces of sinuous pieces 16, 22.

Figure 9:
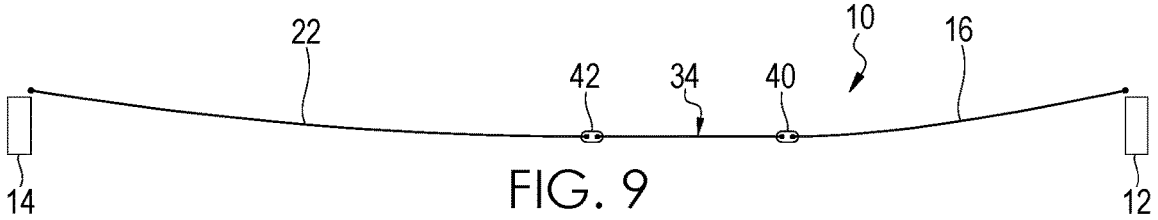
FIG. 9 is a side elevation view of the components of the present invention illustrating the method of assembly of the present invention.

Turning to FIG. 9, therein is shown the third piece of sinuous spring 34 inserted between first 16 and second 22 pieces of sinuous spring wherein there is also shown a first or front clip 40 joining the front or first end of the third piece of sinuous spring 34 to the first piece of sinuous spring 18 along with a second clip 42 which joins the third piece of sinuous spring 34 to the second piece of sinuous spring 22.

Figure 10:
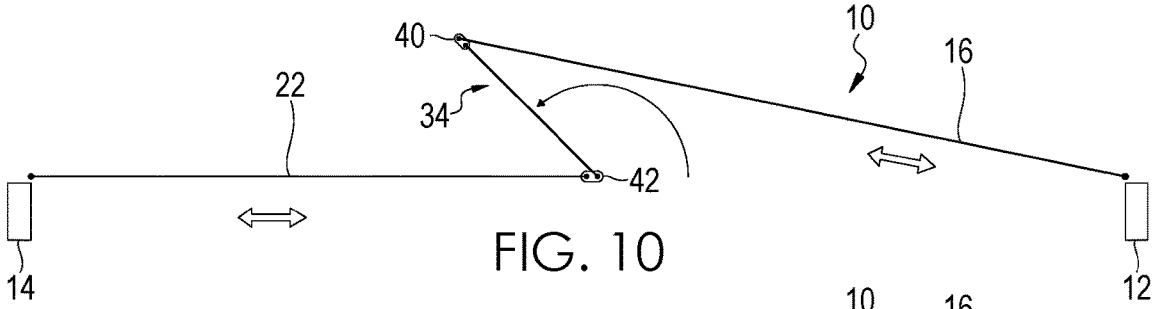
FIG. 10 is a side elevation view of the components of the present invention illustrating the method of assembly of the present invention.

Turning to FIG. 10, therein is shown a process by which the first or front end 36 of the third piece of sinuous spring 34 is folded over a front end portion of the second sinuous spring 22 so that the third piece of sinuous spring 34 can be joined to the second piece of sinuous spring 22 to form single piece of sinuous spring 44 which is shown in FIG. 6.

Figure 11:
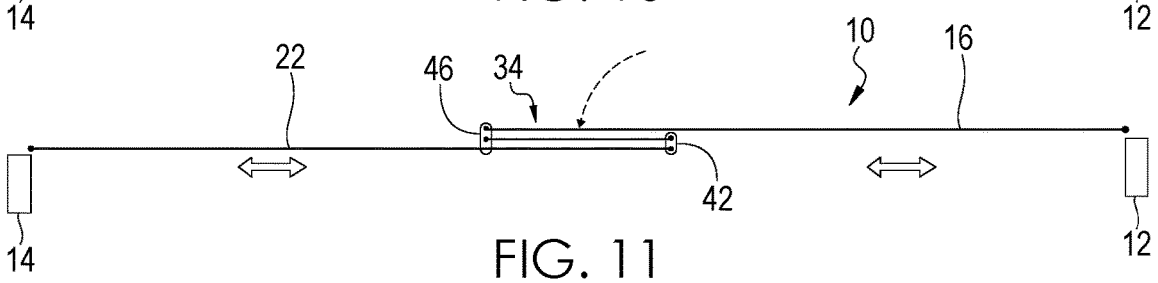
FIG. 11 is a side elevation view of the components of the present invention illustrating the method of assembly of the present invention.

Turning to FIG. 11, therein is shown a newly formed sinuous spring 44 resulting from the completed folding process wherein the sinuous spring 34 is folded over and joined to the second piece of sinuous spring 22 and clipped at 46 so as to form a single length of sinuous spring 44. During the manufacturing process as taught with the present invention 10, each member of sinuous spring is adjusted or pulled so that it is tightened to a user-selected degree so as to support a user-selected load according to the requirements of the piece of furniture being manufactured. To complete the manufacturing process, the new piece of sinuous spring 44 resulting by folding the middle piece of the sinuous spring over the front end of the rear piece of the sinuous spring and clipping the middle piece of the sinuous spring to the rear piece of sinuous spring would be placed inside a seat box in a side-by-side manner to form a cushioned area for being upholstered. Fifth clip 46 attaches all pieces of sinuous spring 16, 22 and 34 together to form a single length of sinuous spring 44.

Figure 12:
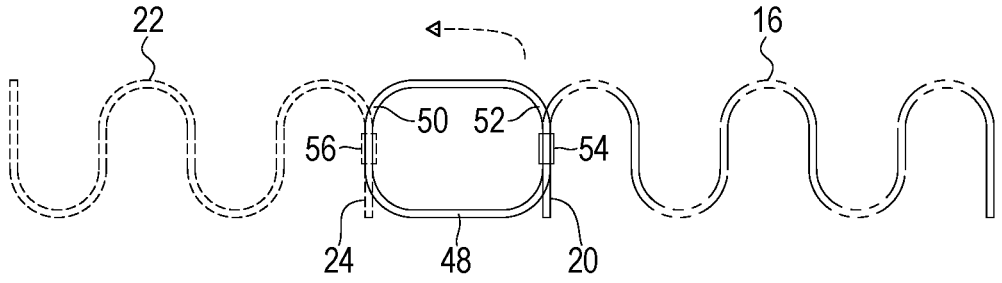
FIG. 12 is a side elevation view of a component of the present invention illustrating an alternative method of assembly of the present invention.
Figure 13:
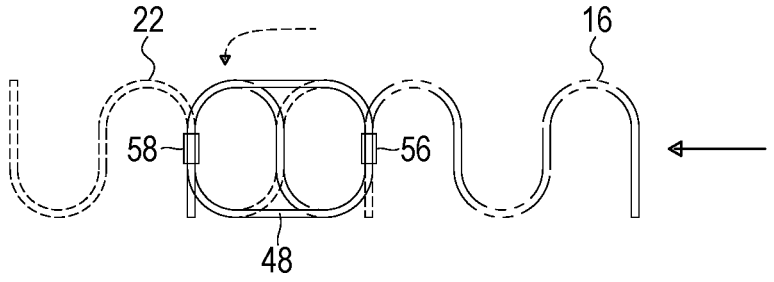
FIG. 13 is a side elevation view of a component of the present invention illustrating an alternative method of assembly of the present invention.

Turning to FIGS. 12-13, and more particularly to FIG. 12, therein is shown an alternative embodiment for joining the two pieces of sinuous spring 16, 22 to each other wherein an oval shaped link 48 is shown having its ends 50, 52 joined directly to ends 20, 24 using link clips 54, 56 so that a single oval link 48 is used to join the two pieces of sinuous spring 16, 22 together. FIG. 13 shows that after the oval link 48 is joined to the ends 20, 24, the first end 52 of the oval link 48 is folded or flipped over link clip 56 to another loop of sinuous wire 22 and then clipped with link clips 56, 58 so as to tighten or shorten the overall length of sinuous spring to an effective degree so as to provide a user-selected tightness of the sinuous spring as taught by the present invention 10. Link clips 54, 56, and 58 are the first, second, and third link clips, respectively, although these clips are sometimes referred to by different written descriptions.

By way of additional general explanation of the present invention 10 and by making reference to FIGS. 1-13, in common manufacturing practice one piece of sinuous spring has a standard 1" pull (which is performed manually by an operator), meaning that a 26" spring is pulled to fit a 27" clip to clip measurement of a seat box. The present invention 10, addresses the difficulty with this operation as it is every upholstery manufacturer's biggest workers compensation cost and thus a major component of the overall manufacturing cost. Assume that a company wishes to manufacture the present invention 10 to compete with a standard 8-gauge 26" sinuous spring operation. In this scenario, the present invention 10 would initially consist of 3 parts as previously explained but the length of the spring would measure about 29" overall as shown in FIGS. 4 and 9. Thus one would have 29" of the 3 piece spring in a 27" clip to clip measurement, so it would have 2" slack or sag (See FIG. 9) and any operator could then perform the flipping or folding process as shown in FIGS. 5 and 10. The purpose of the middle piece 34 is to then fold under one of the two end pieces, doubling under, to then form a 26" long spring 44 (See FIGS. 6 and 11) and be clipped at 46 and pulled to proper tightness as per the requirements of the particular seat box being manufactured. The middle piece would be 3" in this scenario and folded under manually by hand or with some sort of a mechanized gun or like device, and clipped with the same deice. The device is expected to take the motion and effort of pulling the spring away from the operator by folding the middle piece under and clipping it in a mechanized operation. Several clips are used in the written description of the present invention 10 as follows: clips 28, 30, 40, 42, and 46 are the first, second, third, fourth and fifth clips, respectively, although these clips are sometimes referred to by different written descriptions.

I claim:

1. A method for forming a sinuous spring for use in a seat box, comprising the steps of:

a) providing a seat box having front and rear ails, and left and right side rails;

b) providing front, rear, and middle pieces of sinuous spring, wherein each piece has front and rear ends;

c) attaching the front end of the front piece of the sinuous spring to the front rail of the seat box and attaching the rear end of the rear piece of the sinuous spring to the rear rail of the seat box;

d) attaching the front end of the middle piece of the sinuous spring to the rear end of the front piece of the sinuous spring and attaching the rear end of the middle piece of the sinuous spring to the front end of the rear piece of the sinuous spring; and e) forming a first new piece of sinuous spring by folding the middle piece of the sinuous spring over the front end of the rear piece of the sinuous spring and clipping the middle piece of the sinuous spring to the rear piece of sinuous spring.

2. The method of claim 1, further comprising the step of forming the sinuous spring from approximately eight-gauge wire.

3. The method of claim 1, further comprising the step of clipping the pieces of sinuous wire together using clips made of sheet metal.

4. The method of claim 1, further comprising the step of disposing a plurality of the first new piece of sinuous spring inside the seat box in a side-by-side manner to form a cushioned area for the seat box.

5. The method of claim 1, wherein the step of clipping the middle piece of the sinuous spring to the rear piece of sinuous spring further comprises a single oval clip.

6. A sinuous spring construction for use in a seat box:

a) a seat box having front and rear rails, and left and right side rails;

b) a front, rear, and middle piece of sinuous spring, wherein each piece has front and rear ends;

c) wherein said front end of said front piece of said sinuous spring is attached to said front rail of the seat box and said rear end of said rear piece of said sinuous spring is attached to said rear rail of the seat box;

d) wherein said front end of said middle piece of said sinuous spring is attached to said rear end of said front piece of said sinuous spring and said rear end of said middle piece of said sinuous spring is attached to said front end of said rear piece of said sinuous spring; and e) wherein a new piece of sinuous spring is formed as said middle piece of said sinuous spring is folded over said front end of said rear piece of said sinuous spring and said middle piece of said sinuous spring is attached to said rear piece of said sinuous spring by using a clip.

7. The sinuous spring of claim 6, wherein said clip is made of sheet metal.

8. The sinuous spring of claim 6, further comprising a cushioned area for the seat box wherein new pieces of sinuous spring are disposed inside the seat box in a side-by-side manner.

9. The sinuous spring of claim 6, wherein the sinuous spring is made of approximately eight-gauge wire.

* * * * *